US007533725B2

(12) United States Patent
Mese et al.

(10) Patent No.: US 7,533,725 B2
(45) Date of Patent: May 19, 2009

(54) METHOD AND SYSTEM FOR ALTERING PORE PRESSURE IN A FRACTURING OPERATION

(75) Inventors: Ali Mese, Houston, TX (US); Colin M. Sayers, Katy, TX (US); Donald Lee, Houston, TX (US); Patrick J. Hooyman, Houston, TX (US)

(73) Assignee: Schlumberger Technology Corp., Houston, TX (US)

( * ) Notice: Subject to any disclaimer, the term of this patent is extended or adjusted under 35 U.S.C. 154(b) by 130 days.

(21) Appl. No.: 11/648,036

(22) Filed: Dec. 29, 2006

(65) Prior Publication Data

US 2008/0156484 A1 Jul. 3, 2008

(51) Int. Cl.
*E21B 43/26* (2006.01)

(52) U.S. Cl. ..... 166/308.2; 166/177.5

(58) Field of Classification Search ..... None
See application file for complete search history.

(56) References Cited

U.S. PATENT DOCUMENTS 6,069,118 A * 5/2000 Hinkel et al. ..... 507/277
6,422,325 B1 * 7/2002 Krieger ..... 175/50
6,509,301 B1 * 1/2003 Vollmer ..... 507/236

* cited by examiner

*Primary Examiner*—William P Neuder
(74) *Attorney, Agent, or Firm*—Robert P. Lord; Dona C. Edwards; Bryan P. Galloway

(57) ABSTRACT

A method and a system for accessing a target fluid in a formation of an oilfield are provided. The method involves acquiring physicochemical property information of a portion of the formation, determining a type and a concentration of a chemical agent based on the physicochemical property information of the portion of the formation, and applying the chemical agent at the portion of the formation to provide a chemical action, where the target fluid is released at the portion of the formation responding to the chemical action.

17 Claims, 9 Drawing Sheets

METHOD AND SYSTEM FOR ALTERING PORE PRESSURE IN A FRACTURING OPERATION

BACKGROUND

Oilfield activities involve various sub-activities used to locate and gather hydrocarbons. Various tools, such as seismic tools, are often used to locate the hydrocarbons. One or more wellsites may be positioned along an oilfield to locate and gather the hydrocarbons from subterranean reservoirs of an oilfield. The wellsites are provided with tools capable of advancing into the ground and removing hydrocarbons from the subterranean reservoirs. Production facilities are positioned at surface locations to collect the hydrocarbons from the wellsite(s). A target fluid is drawn from the subterranean reservoir(s) and passes to the production facilities via transport mechanisms, such as tubing. Various equipment is positioned about the oilfield to monitor and manipulate the flow of hydrocarbons from the reservoir(s).

During oilfield activities, it is often desirable to monitor various oilfield parameters, such as fluid flow rates, composition, etc. Sensors may be positioned about the oilfield to collect data relating to the wellsite and the processing facility, among others. For example, sensors in the wellbore (or borehole) may monitor fluid composition, sensors located along the flow path may monitor flow rates, and sensors at the processing facility may monitor fluids collected. The monitored data is often used to make real-time decisions at the oilfield. Data collected by these sensors may be further analyzed and processed.

The processed data may be used to determine conditions at the wellsite(s) and/or other portions of the oilfield, and make decisions concerning these activities. Operating parameters, such as wellsite setup, drilling trajectories, flow rates, wellbore pressures, production rates and other parameters, may be adjusted based on the received information. In some cases, known patterns of behavior of various oilfield configurations, geological factors, operating conditions or other parameters may be collected over time to predict future oilfield activities.

Oilfield data is often used to monitor and/or perform various oilfield activities. There are numerous factors that may be considered in operating an oilfield. Thus, the analysis of large quantities of a wide variety of data is often complex. Over the years, oilfield applications have been developed to assist in processing data. For example, simulators, or other scientific applications, have been developed to take large amounts of oilfield data and to model various oilfield activities. Typically, there are different types of simulators for different purposes. Examples of these simulators are described in Patent/Application Nos. U.S. Pat. No. 5,992,519, WO2004049216 and U.S. Pat. No. 6,980,940.

Numerous oilfield activities, such as drilling, evaluating, completing, monitoring, producing, simulating, reporting, etc., may be performed. Typically, each oilfield activity is performed and controlled separately, sometimes with the use of computer systems using separate oilfield applications that are each written for a single purpose. Thus, many such activities are often performed using separate oilfield applications. In some cases, it may be necessary to develop special applications, or modify existing applications to provide the necessary functionality, such as modeling borehole stability.

In one example, an established model for borehole stability is found in the paper "A Borehole Stability Model To Couple the Mechanics and Chemistry of Drilling Fluid/Shale Interaction" by Mody et al., published as SPE25728 at 1993 IADC/SPE Drilling Conf., Amsterdam, Feb. 23-25, 1993. In another example, a Pore Pressure Transmission (PPT) experiment is described in the paper "Interpretation and Application of Acoustic and Transient Pressure Response to Enhance Shale (In)Stablility Predictions" by Tare et al., published as SPE63052 at 2000 SPE Annual Technical Conference and Exhibition, Dallas, Oct. 1-4, 2000, which is also incorporated herein by reference. The PPT experiment is designed to study time-dependent alterations in shale properties as a function of exposure to drilling fluid. In this paper, a pore pressure change up to 1640 psi (pounds per square inch) was reported based on simulated drilling fluid interaction with shale samples.

FIG. 1 shows a schematic of an experiment for modeling wellbore stability. More details regarding the experiment can be found in SPE63052 referenced above. The experiment establishes a simulation of a type of rock that may be found at or near a formation bearing hydrocarbons or other fluids. In particular, the experiment simulates the pressure and temperature of the formation and fluids under varying circumstances. A rock sample 6, for example from a Pierre shale formation, is placed in a vessel 18 filled with a hydraulic fluid 13. The rock sample 6 is held separate from, but within, the hydraulic fluid 13 by an impermeable jacket 10 (shown as a cross section surrounding the rock sample) and end caps (e.g., lower end cap 14, upper end cap 16). A test fluid is applied at varying pressures to the rock sample 6 circulating through an ingress pipe 2 and egress pipe 4. As a pore pressure of the rock sample 6 responds to the circulating test fluid, a pore pressure gauge 8 reports a changing pressure. In a subterranean formation simulated by the experiment, the pore pressure is the pressure of pore fluid. Pore fluid is a fluid that occupies the gaps between mineral particles of a formation.

Pierre shale, which is used as the rock sample 6 in the experiment shown in FIG. 1, is a substance found in a formation and may be simulated as described above. While Pierre shale is used in the experiment shown in FIG. 1, the experiment is equally applicable to other subterranean formations in various combinations (e.g., sand, clayey sandstone, clay-shale composed of mixed-layer smectite, kaolinite, illite, montmorillonite, chlorite, vermiculate, quartz etc.). In addition, shale may also include varying mixtures of clay, feldspars, pyrite, dolomite, calcite, and apatite, among other minerals.

FIG. 2 shows a graphical representation of pore pressure in an experiment for modeling wellbore stability. More details regarding this experiment can be found in SPE63052 referenced above. Referring to the graph 19, along a vertical axis 21, pressure is recorded in pounds per square inch (psi). Time is measured along a horizontal axis 23. Using the experiment as shown in FIG. 1, the experimenter applies a confining pressure to the rock sample 6, in this example Pierre shale, through hydraulic pressure established inside the vessel 18. At an initial time (time equal to 0 on the horizontal axis) the confining pressure is 1000 psi, and is traced by confining pressure line 20 (in FIG. 2). Initially a simulated pore fluid of an eight percent concentration of salt (solute) in water (solvent) is applied through the ingress pipe 2 (in FIG. 1), traced by pore pressure line 22 (in FIG. 2), to saturate the rock sample 6 (in FIG. 1). As used in this experiment, concentration is a measure of the proportion to which a solvent contains or dissolves a solute. Concentration may be calculated by dividing the amount of solute into the amount of solvent.

Continuing with FIG. 2, once the saturation is achieved during a first time interval 24, the experimenter increases the confining pressure until the confining pressure reaches 4000 psi. In response, the pore pressure climbs, peaks, and settles to an approximate equilibrium pressure at approximately time 5000 minutes after the initial time. Upon the stabilization of the pore pressure after a second time interval 26, the pore fluid is replaced with a drilling fluid that is circulated at a constant pressure. The time-dependent transient behavior of the pore pressure is then recorded in a third time interval 28. The drilling fluid used in the experiment shown in the graph of FIG. 2 is a sodium silicate system containing a 20 percent concentration salt solution. Pore pressure, shown on pore pressure line 22 declines from a high of 3140 psi to approximately 1640 psi. It was pointed out in SPE63052 that reduced pore pressure contributes towards enhancing wellbore stability on a time-dependent basis.

Additional studies on wellbore instability can be found in the paper "Shale-Fluid Interactions Measured Under Simulated Downhole Conditions" by Ewy et al., published as SPE/ISRM 78160 at 2002 SPE/ISRM Rock Mechanics Conference, Irving Tex., Oct. 20-23, 2002. Ewy reports that a pore pressure change up to 1000 psi is caused by shale exposure to a salt solution. This paper, along with the papers SPE25728 and SPE63052 referenced above, relates only to the drilling fluid interaction with shale in the wellbore during a drilling operation.

Studies conducted to enhance wellbore stability during cementing operation in a wellbore have also been described in the paper "Understanding Formation (In)Stability During Cementing" by Heathman et al., published as SPE/IADC 79913 at 2003 SPE/IADC Drilling Conference, Amsterdam, Feb. 19-21, 2003. This paper concerns with cementing fluid/shale interaction in the wellbore during a cementing operation.

More recently, wellbore stability is described in the paper "Stressed Shale Drilling Strategy—Water Activity Design Improves Drilling Performance" by Rojas et al. published as SPE 102498 at 2006 SPE Annual Technical Conference, San Antonio Tex., Sep. 24-27, 2006. Rojas reports that a pore pressure change up to 1000 psi is caused by shale exposure to salt solution. In the paper, the authors note that "Non-aqueous drilling fluids are often chosen to drill troublesome shale formations." Rojas describes maintaining the integrity and stability of the wellbore in shale formations and refers to a common practice of increasing the drilling fluid salt content to enhance the borehole stability. Rojas further describes that the osmotic effect is a valuable tool for helping maintaining stability in the wellbore.

The papers referenced above describe that wellbore stability in shale formations is estimated to cost the petroleum industry, according to conservative estimates, $700 million to over $1 billion annually. Understanding and modeling mechanisms of shale stability is an ongoing industry effort. Since at least as early as the SPE 4232 paper in 1973 (SPE 4232, September 1973, Stabilizing sensitive shales within inhibited potassium based drilling fluids) until the recent SPE 102498 paper in 2006, the major concerns of the drilling engineer are to keep the wellbore wall from collapsing inward, swelling and, at the same time, to avoid fracturing the wellbore wall and losing circulation.

Another example of an oilfield activity is hydraulic fracturing. Fracturing refers to methods used to stimulate the production of target fluids (i.e., hydrocarbons) resident in the subsurface, for example, oil, natural gas, and brines.

A fracture is a crack or surface of breakage within rock or a formation. Often, fracturing creates a fracture zone through which target fluids and hydrocarbons can more easily flow to the wellbore. A fracture zone is a zone having multiple fractures, or cracks in the formation. A typical fracture zone is shown in context, in FIG. 3.

FIG. 3 shows a diagram of hydraulic fracturing used in oilfield operation. The wellbore 30 extends to and potentially through the fracture zone 32. The vertical extent of the hydrocarbon-producing zone can be coextensive with the fracture-zone height. These two coextensive zones are shown bounded by upper bound 34 and lower bound 45. Fractures are created in a target formation by applying hydraulic pressure through perforations 36, 38, 40, 42, 44, 46 in the well casing. The perforations 36, 38, 40, 42, 44, 46 allow the fracturing fluid to flow from wellbore 30 to the target formation. The reservoir may be present beyond a single fracture zone 32 in the subterranean formation.

Hydraulic fracturing involves literally breaking or fracturing a portion of the surrounding strata, by injecting a specialized fluid into the wellbore directed at the face of the geologic formation at pressures sufficient to initiate and extend a fracture in the formation. More particularly, when a fluid is injected through a wellbore, the fluid may exit through holes or perforations in the well casing and against the face of the formation. The fluid flows at a pressure and flow rate sufficient to overcome the minimum in situ stress (also known as minimum principal regional stress) to initiate and/or extend a fracture(s) into the formation. In practice, fracturing a well can be a highly complex operation performed with orchestration of equipment, engineers and technicians, and computers that monitor rates, pressures, volumes, in real time.

During a typical fracturing job, tens of thousands of gallons of materials can be pumped into the formation at pressures high enough to actually split the formation, thousands of feet below the earth's surface. Fracturing fluids of the prior art may be based on oil, water, a combination of water and methanol or water and oil. Highly viscous fracturing fluids have been the preferred choice. As a result, pumps with great power are used to inject the fracturing fluids, as well as remove them. The fracturing fluids, other than the salt content they may contain, are considered inert in the sense that they typically have low ionic concentrations when introduced to the wellbore. Fracturing fluids may also be used to transport proppants. A proppant is a solid granular material that may lodge in a fracture and support the sides of the fracture, keeping it open. A proppant may not be effective if the formation adjacent the fractures contains shale or clayey sandstone which may soften because of water adsorption.

SUMMARY OF INVENTION

In general, in one aspect, the present invention involves a method for accessing a target fluid in a formation of an oilfield having at least one wellbore. The method comprises acquiring physicochemical property information of a portion of the formation, determining a type and a concentration of a chemical agent based on the physicochemical property information of the portion of the formation, and applying the chemical agent at the portion of the formation to provide a chemical action, wherein the target fluid is released at the portion of the formation responding to the chemical action.

In general, in one aspect, the present invention involves a method for accessing a target fluid in a formation of an oilfield having at least one wellbore. The method comprises acquiring physicochemical property information of a portion of the formation, determining types and concentrations of a first and second chemical agent based on the physicochemical property of the portion of the formation, applying a hydraulic pressure exceeding a threshold to form a fracture in the portion of the formation, applying the first chemical agent at the portion of the formation to reduce the threshold based on a chemical action, and applying the second chemical agent to harden the formation adjacent to the fracture based on the chemical action, wherein the hardened formation allows the fracture to stay open and release the target fluid at the portion of the formation.

In general, in one aspect, the present invention involves a system for accessing a target fluid in a formation of an oilfield having a wellbore intersecting a portion of the formation. The system comprises a chemical agent for providing a chemical action at the portion of the formation, equipment for acquiring physicochemical property information of the portion of the formation, means for determining a type and concentration of the chemical agent based on the physicochemical property, and means for applying the chemical agent at the portion of the formation to release the target fluid in the portion of the formation responding to the chemical action.

Other aspects and advantages of the invention will be apparent from the following description and the appended claims.

DETAILED DESCRIPTION

Figure 1:
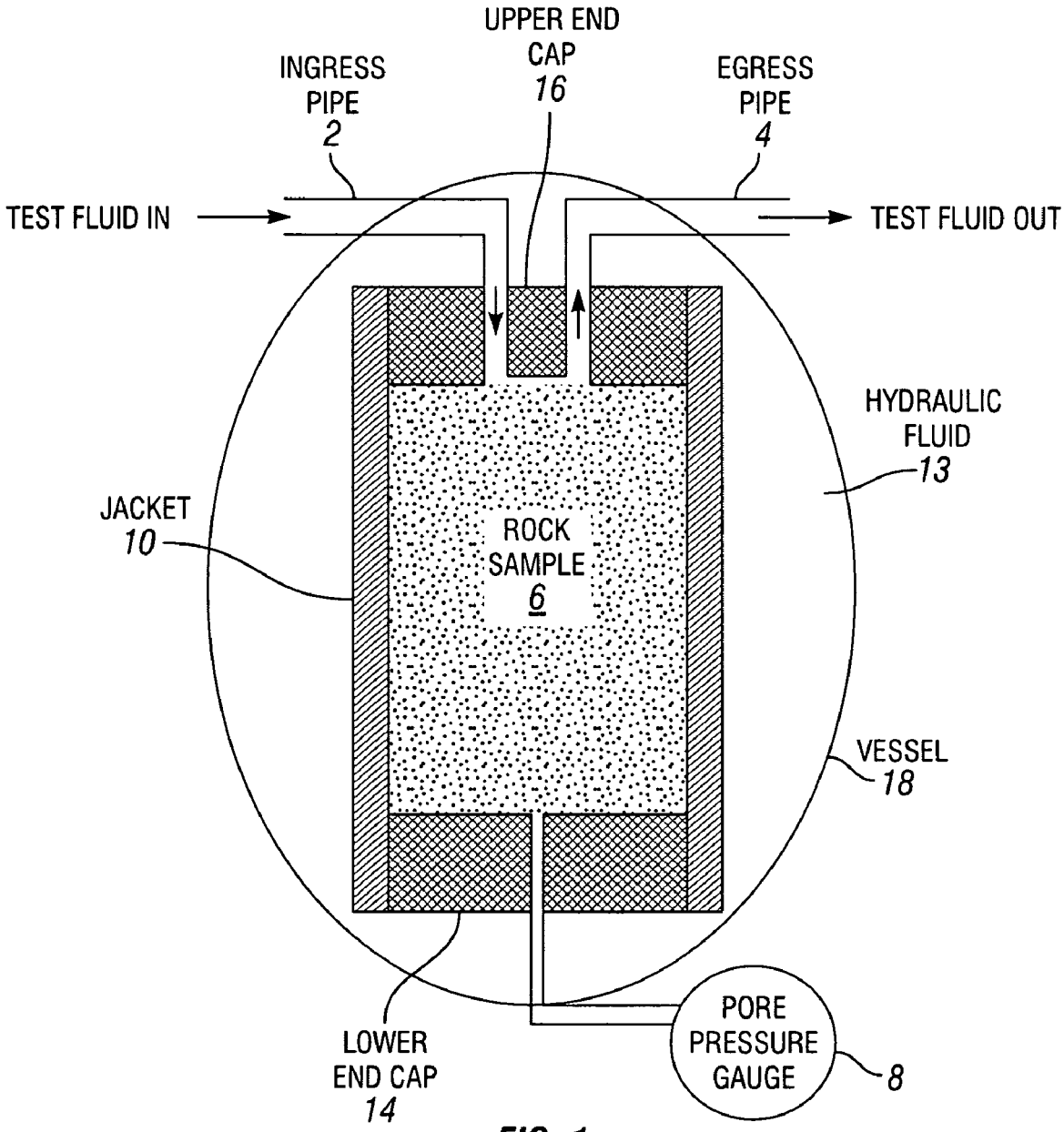
FIG. 1 (Prior Art)
FIG. 1 shows a schematic of an experiment for modeling wellbore stability.

Specific aspects of the invention will now be described in detail with reference to the accompanying figures. Like elements in the various figures are denoted by like reference numerals for consistency.

In the following detailed description of aspects of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, aspects of the invention relate to resolving a problem associated with accessing target fluid, such as hydrocarbon, in a formation, such as shale, clayey sandstone, or other low permeability formations.

Figure 2:
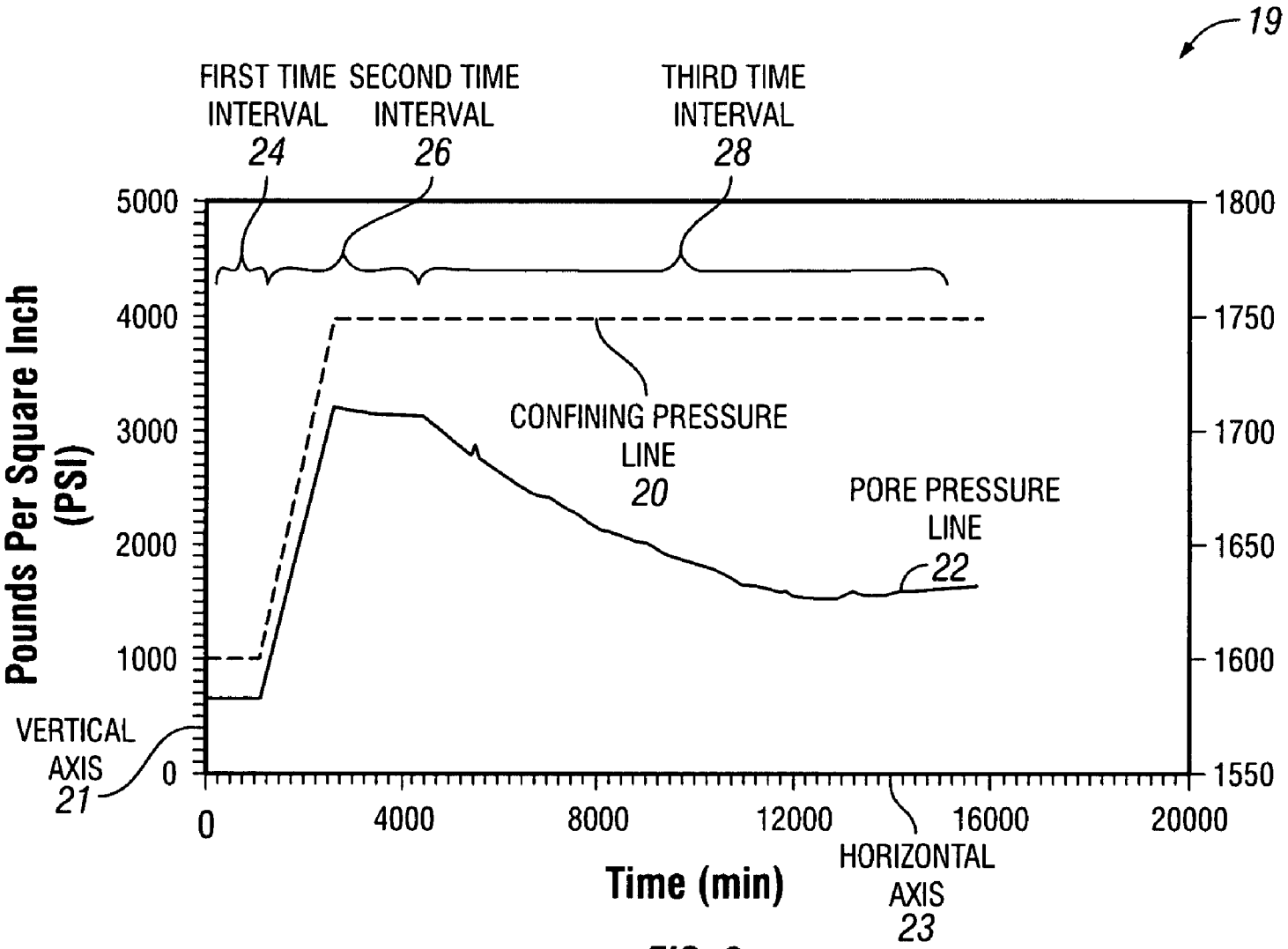
FIG. 2 (Prior Art)
FIG. 2 shows a graphical representation of pore pressure in an experiment for modeling wellbore stability.
Figure 3:
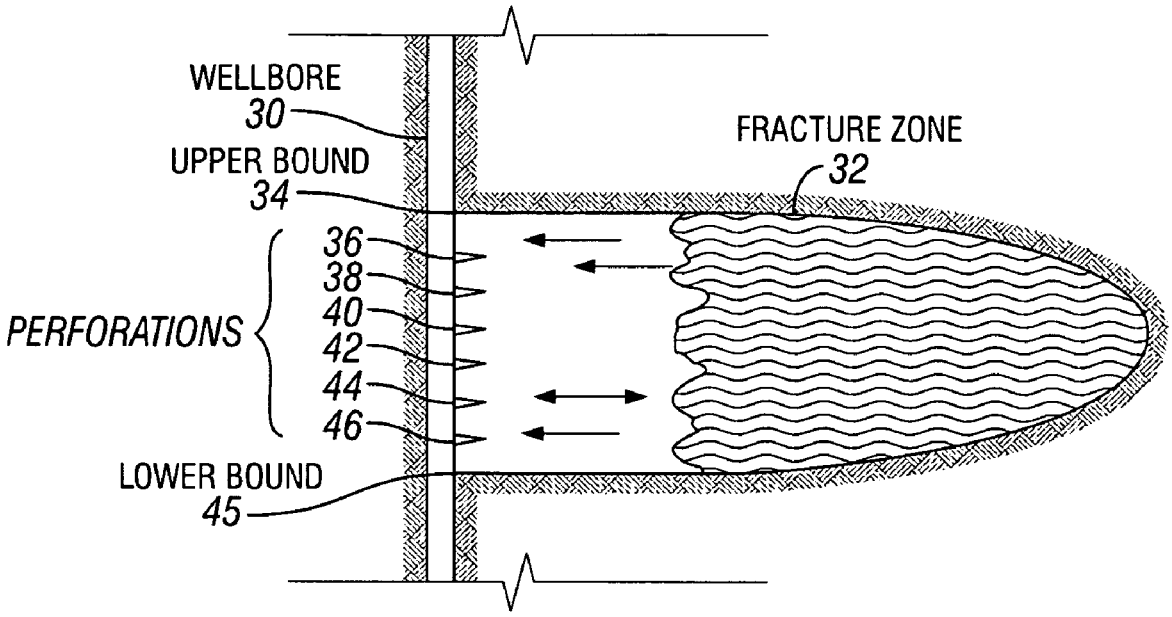
FIG. 3 (Prior Art)
FIG. 3 shows a diagram of hydraulic fracturing used in oilfield operation.

As described above, FIGS. 1-3 depict an overview of an example containing various aspects of the oil and gas industry. Briefly, an oilfield activity may take many forms including operations performed before any drilling occurs, such as, for example, exploration, analysis, etc. In addition, an oilfield activity may include activities occurring after drilling, for example, well work over and intervention, as well as storage, transport and refining of hydrocarbons. Furthermore, an oilfield activity may also include activities performed during drilling.

Figure 4:
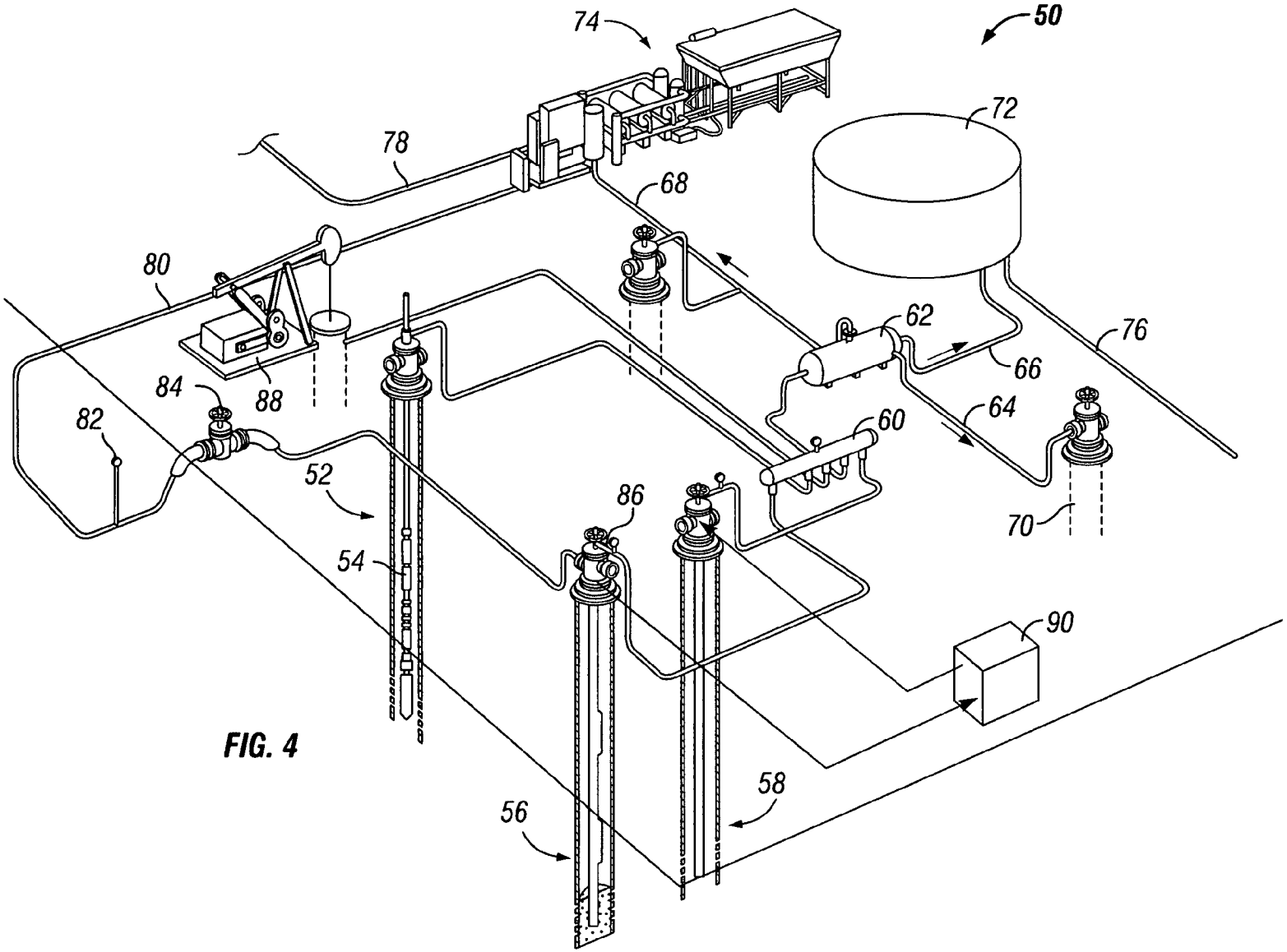
FIG. 4 shows an exemplary oilfield activity with wellbores linked to an operations control center.

FIG. 4 shows an exemplary oilfield activity with wellbores linked to an operations control center. An oilfield activity 50 is depicted including machinery used to extract hydrocarbons, such as oil and gas, or other fluids from down-hole formations. An operations control center 90 may assist in collecting data and making decisions to enhance operations in the oilfield. Data may include, for example, measurements of bottom hole pressure and tubing head pressure.

As shown in FIG. 4, the oilfield activity 50 includes a number of wells. Specifically, the oilfield activity 50 includes first producing well 52, which uses an electric submersible pump 54 to produce a hydrocarbon (e.g., oil, gas, etc.); a second well 56, which relies on a gas lift to produce a hydrocarbon; and a third well 58, which produces a hydrocarbon on the basis of natural flow. First producing well 52, second well 56, and third well 58 deliver production fluids (e.g., hydrocarbon produced from their respective wells) to a production manifold 60. The production manifold collects multiple streams and outputs the streams to a gas and oil separator 62.

Upon receipt of the production fluids by the gas and oil separator 62, the gas and oil separator 62 separates various components from the fluids, such as produced water 64, produced oil 66, and produced gas 68, respectively to water disposal well 70, oil storage 72, and a compressor station 74. Oil storage 72 may transfer oil via an oil export pipeline 76. Similarly, the compressor station 74 may use gas export pipeline 78 to transfer gas. Finally, the compressor station 74 may process gas as an injection gas 80.

In order to adjust pressure on the injection gas, a meter and control system 82 may cooperate with an injection-gas manifold 84. The operation of the meter and control system 82 may regulate pressure of the injection gas as the injection gas is delivered to a wellhead tubing and casing 86. In addition to the injection gas, extracting efforts may rely upon a rod pump 88 to drive a downhole pump assembly via a reciprocating motion. In such cases, the rod pump 88 propels hydrocarbons to the production manifold 60.

In one aspect of the invention, the operations control center 90 may receive data from sensors corresponding to the second well 56. Examples of sensors are depicted and described in further detail with respect to FIG. 5. The sensors may include, for example, a pressure sensor that measures fluid pressures at the wellhead. The operations control center 90 may also operate and/or control equipment in the third well 58.

Figure 6:
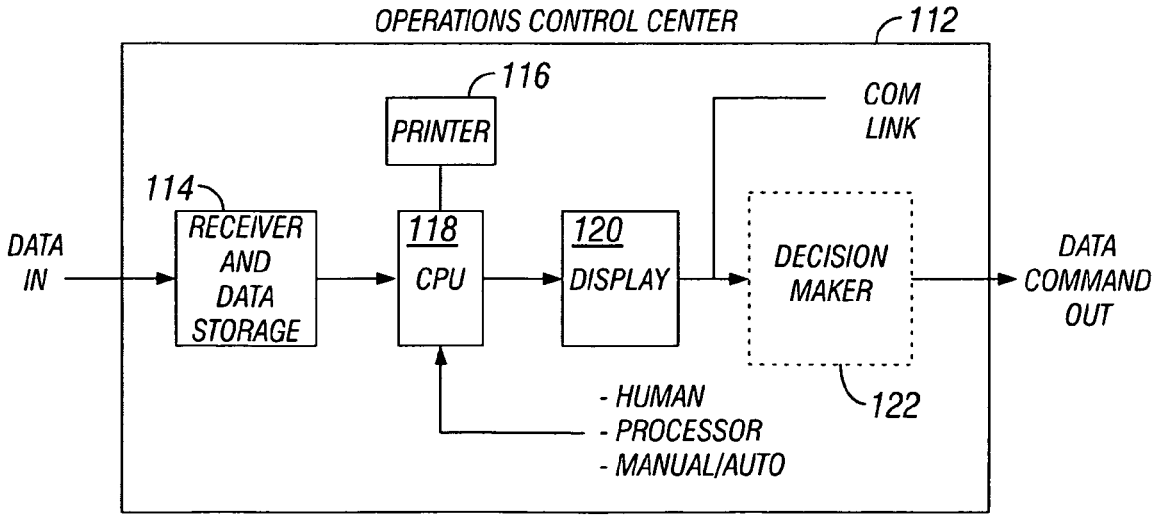
FIG. 6 shows a detailed view of an operations control center.

An operations control center 90 may use a data processing system including various components, such as those depicted in FIG. 6. In particular, a central processor unit (CPU), e.g., a microprocessor, is preferably configured to execute one or more of the sets of instructions to control, for example, the operation of the third well 58. Finally, the communication unit preferably operates as an interface between the operations control center 90 and the other oilfield operations components. As such, the communications interface may be configured to receive data from the oilfield operations components and to send commands and/or data to the oilfield operations components.

Figure 5:
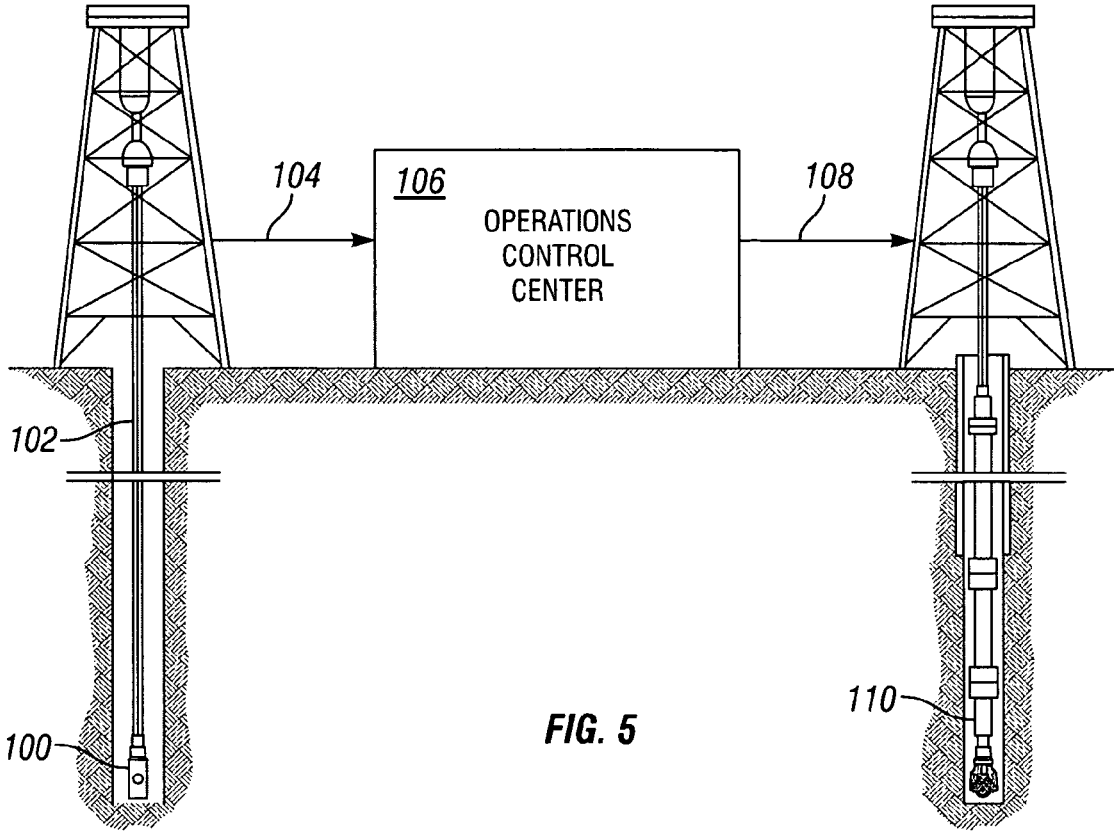
FIG. 5 shows two wellbores in communication with an operations control center.

FIG. 5 shows two wellbores in communication with an operations control center. This diagram depicts the cooperation of the operations control center 106 with at least two wells. As discussed above, a purpose of the operations control center 106 is to collect data and control a drilling operation. The down-hole sensors 100 and well-head sensors 102 provide data (i.e., data collected and/or otherwise obtained from the down-hole sensors 100 and/or the well-head sensors 102). Upon receipt of the information, a first communication link 104 transfers the aforementioned data to the operations control center 106.

The operations control center 106 stores and, in some cases, optionally processes and/or analyzes the data. In some cases, the operations control center 106 may also generate and transmit control signals via the second communication link 108 to a down-hole apparatus 110. For example, the operations control center 106 may automatically generate control signals using data obtained via the first communications link 104. In another example, the operations control center 106 may provide information to an operator that may consider the information, and then send control signals as desired. In addition, in some aspects of the invention, the operations control center 106 may also provide feedback to down-hole sensors 100 and/or well-head sensors 102 using data obtained via the first communications link 104.

FIG. 6 shows a detailed view of an operations control center. A receiver and data storage 114 corresponds to a device configured to receive and store data, for example, from a sensor (ie., 100, 102 of FIG. 5) or other components internal and/or external to the operations control center 112. Receiver and data storage 114 may be implemented, for example, using a magnetic storage device, an optical storage device, a NAND storage device, or any combination thereof, etc.

A CPU 118 (e.g., a microprocessor) is configured to process data (e.g., data stored in the receiver and data storage 114), to store processed data and/or generate commands to operate various oilfield components shown in FIGS. 4 and 5. In addition, the CPU 118 may operate output devices such as a printer 116, for example, to print out a questionnaire for collecting opinions. The CPU 118 may also operate a display device 120 (e.g., a monitor, etc.). A decision-maker 122 may optionally contribute to selecting a work element for enhancing. For example, the decision-maker 122 may operate a keyboard or mouse (not shown) to perform analysis of physicochemical property information obtained using, for example, log data analysis, direct measurement of the target formation or by analyzing cuttings (i.e., cutting analysis) (discussed below). The CPU 118 may also store such physicochemical property information or analysis results (discussed below) to the receiver and data storage 114.

Further, those skilled in the art will appreciate that one or more elements of the operations control center 106 may be located at a remote location and connected to the other elements over a network. Further, the invention may be implemented on a distributed system having a plurality of nodes, where each portion of the invention (e.g., acquisition equipment, analysis equipment, etc.) may be located on a different node within the distributed system. In aspects of the invention, the node corresponds to a computer system. Alternatively, the node may correspond to a processor with associated physical memory. The node may also correspond to a processor with shared memory and/or resources. Further, software instructions to perform aspects of the invention may be stored on a computer readable medium such as a compact disc (CD), a diskette, a tape, a file, or any other computer readable storage device.

Figure 7:
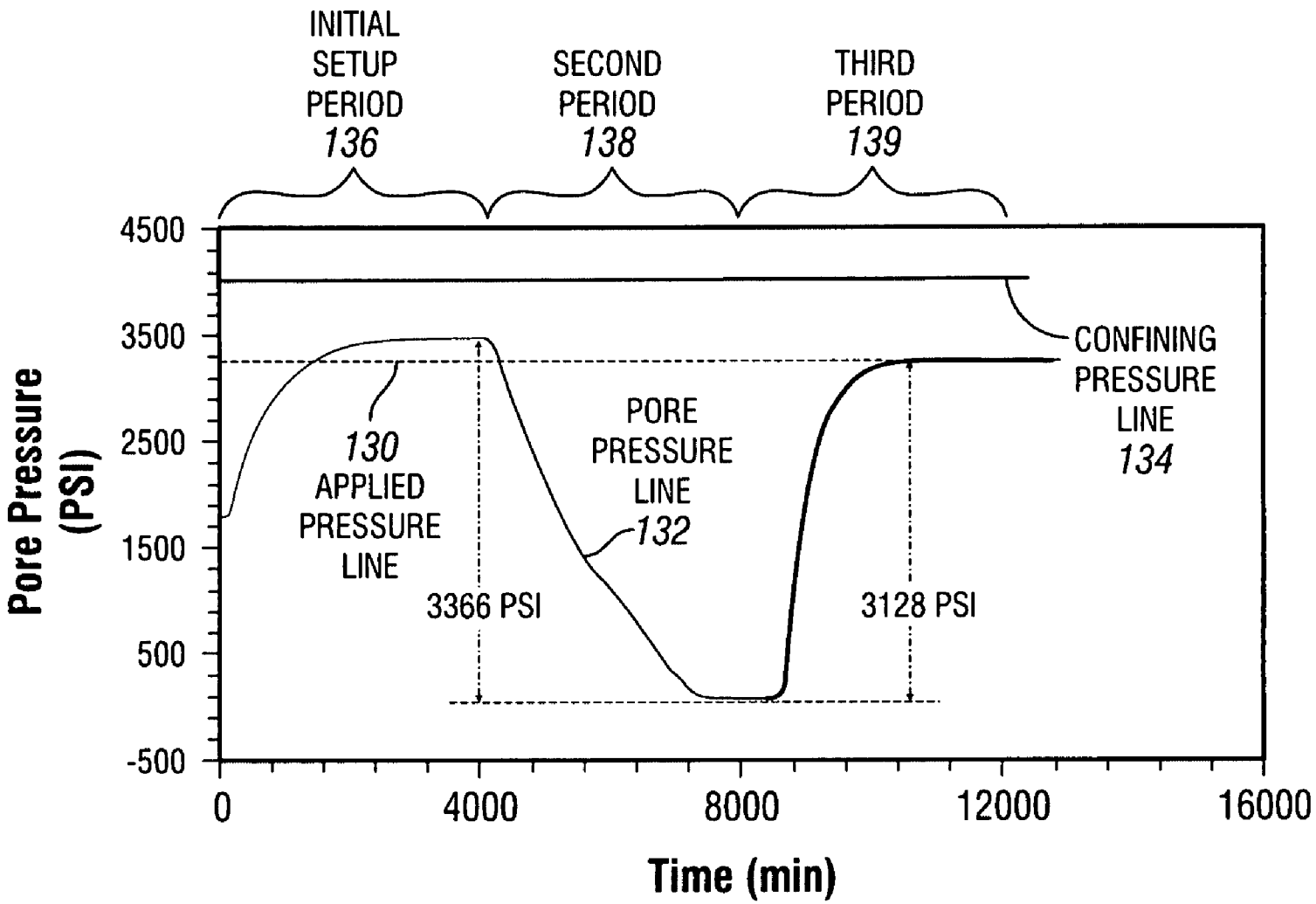
FIG. 7 shows a graphical representation of pore pressure in accordance with aspects of the invention.

FIG. 7 shows a graphical representation of pore pressure in accordance with aspects of the invention. The graphical representation is based on an experiment, which may be conducted with the apparatus of FIG. 1. This particular experiment uses a rock sample of Pierre shale and a confining pressure of approximately 4000 psi as shown by the confining pressure line 134. During an initial setup period 136, a test fluid (such as water) is applied at a pressure of approximately 3150 psi, as shown by the applied pressure line 130. The pore pressure responds accordingly as shown by the pore pressure line 132.

Next, a first chemical agent, e.g., formate, which is a salt (i.e., ionic compound) or ester (i.e., organic compound) of formic acid ($HCOO^-H^+$), is applied during a second period 138. The first chemical agent and other test fluids are applied at a constant pressure shown by the applied pressure line 130. As shown by the pore pressure line 132 during the second period 138, pore pressure declines markedly in response to the application of the first chemical agent. This change of 3366 psi has never before been achieved in prior art wellbore stability modeling experiments referenced above.

Next, the applied chemical agent is replaced by a second chemical agent, for example, an eight percent concentration of salt in water during the third period 139. During this time period, pore pressure climbs to 3128 psi, as shown by the pore pressure line 132. Again this change has never before been achieved in prior art wellbore stability modeling experiments. The declining pore pressure represents the dehydration of the rock sample (such as Pierre shale) and increased effective stress on the rock sample. Dehydration of shale (and other similar and/or surrounding formations) and increased effective stress may lead to disintegration of the rock sample. Applied to a target formation, a shale dehydration (and dehydration of other similar and/or surrounding formations) and decreased pore pressure may open up more fractures or micro-fractures as compared to a similarly situated shale without dehydration.

Pore fluid may be removed by operation of chemical action. Chemical action is any operation of a chemical, dissimilar to the pore fluid, that causes movement of the pore fluid. Chemical action may be, for example, osmotic action. Conditions similar to the experiment described above may be used to remove pore fluid by adjusting the chemical potential, pressure, or temperature of a test fluid. In the context of this invention, chemical potential is a function of the mole fraction of ionic concentration of a fluid.

Applying a test fluid that has a lower chemical potential than the pore fluid of a rock formation, such as Pierre shale, creates an osmotic pressure gradient from the rock formation, such as Pierre shale, to the flowing test fluid. Consequently, an osmotic pressure gradient is formed when the test fluid has a lower chemical potential than the chemical potential of the pore fluid. The bias that pushes fluid from the rock formation is osmotic action. As used herein, osmotic action is the net movement of water through a permeable membrane or equivalent from a region of low solute potential to a region of high solute potential (or equivalently, from a region of high solvent potential to a region of low solvent potential). Rock formations that are considered shales and clayey sandstones present an interface to a fluid provide the equivalent of a permeable membrane. Consequently, a target formation may either be weakened (for example, by applying chemical agent during period 138) or strengthened (for example, by applying chemical agent during period 139). The magnitude of pore pressure change demonstrated in the experiment shown and described in relation to FIG. 7 is sufficient to create fractures or micro-fractures in shale or clayey sandstone formations in a oilfield.

Figure 8:
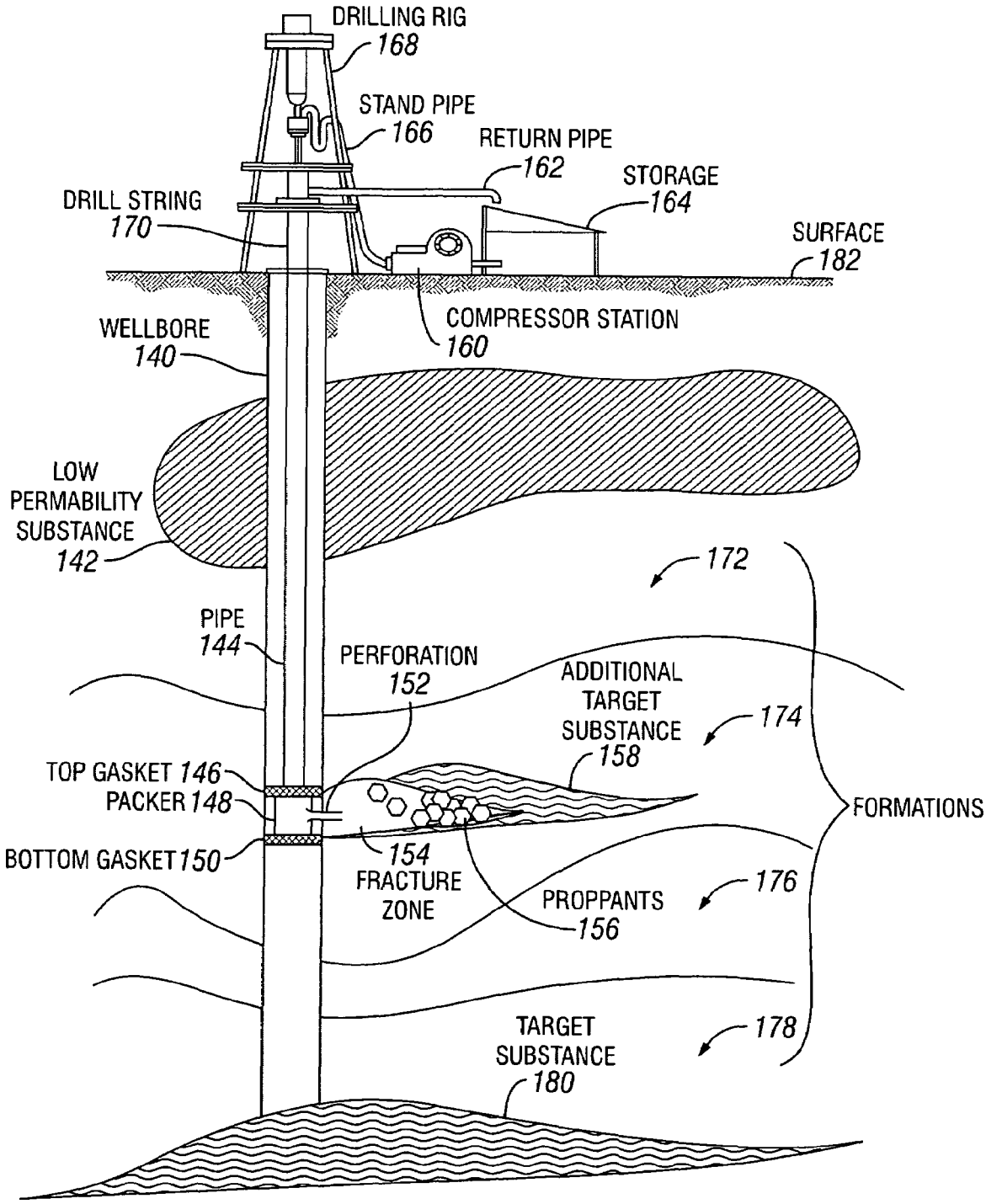
FIG. 8 shows a schematic of an open hole drilling operation for accessing the target fluid in a formation in accordance with aspects of the invention.

FIG. 8 shows a schematic of an open hole drilling operation for accessing the target fluid in a formation in accordance with aspects of the invention. Described below is one method of using the oilfield operation shown in FIG. 8 to access target fluids in low permeability formations. One skilled in the art will appreciate that the invention may be practiced in many different ways using various configurations of oilfield equipment. Accordingly, the invention should not be limited to only the aspect of the invention shown and described in FIG. 8.

Turning to FIG. 8, drilling rig 168 may be established at a surface 182 (e.g., earth surface, subsea surface, seafloor, etc.). Workers on the drilling rig 168 may extend a drill string 170 through a wellbore 140 which may penetrate formations 172-178 from the surface 182. Below the surface 182 varying mineral structures and rock formations may exist. For example, a low permeability substance 142 may extend over and above a target substance 180. The target substance 180 may reside in a high permeability formation 178, such as a sandstone formation. An additional target substance 158 may reside in a low permeability formation 174, such as a shale formation or a clayey sandstone formation.

When encountering such target substances found in a low permeability formation 174, osmotic action and other chemical action may be applied to a portion of the low permeability formation 174 for accessing the additional target substance 158 which may not be feasible, practicable and/or economical to retrieve using techniques available in the prior art. Thus, using the techniques described above in relation to FIG. 7, the additional target substance 158 may be accessible and improve the oilfield output.

A compressor station 160 may receive a chemical agent from storage 164. The compressor station 160 may be used to pump the chemical agent through a stand pipe 166. The stand pipe 166 delivers the chemical agent to a pipe 144, within the drill string 170, that penetrates through the packer 148. A return pipe 162 may return the chemical agent from the wellbore 140 back to the storage 164. The packer 148 may be used to isolate an area (e.g., a portion of a formation) along the wall of the wellbore 140 between the top gasket 146 and the bottom gasket 150 to contain and apply the chemical agent through one or more perforations (e.g., perforation 152) to a target formation. A fracture zone 154 may develop as a result of exposing a portion of the low permeability formation 174 (containing the additional target substance 158) to the chemical agent. When applying the chemical agent, proppants 156 may be included in the chemical agent. As described above, proppants are a solid granular material that may lodge in a fracture and support the sides of the fracture to prevent it from closing under the in situ stress. In aspects of the invention, the proppants 156 may contain time-released capsules containing formate and/or an ionic compound. Depending on the needs of the particular formation, the proppants and other solids in the chemical agent may reach two or more faces of a fracture 152 in a portion of the formation.

In another example, the target substance 180 may initially be determined, or estimated to reside in a sandstone formation but subsequently be more accurately determined to reside in a clayey sandstone formation or a shale formation, i.e., the formation 178 may be more accurately determined to contain clayey sandstone or shale upon being accessed by the actual drilling process. The packer 148 may be lowered by the drill string 170 to extend the reach of the pipe 144 for applying the chemical agent to a portion of the formation 178 to develop fractures or micro-fractures and enhance the permeability and, therefore, the access to the target substance 180.

In yet another example, the production of the target substance 180 through the wellbore 140 may be in a final phase using prior art techniques where the production output may have been decreasing steadily to an uneconomical level for continuing production. Physicochemical property information of various formations along the wellbore 140 may be acquired to determine a chemical agent with appropriate type, concentration, quantity, temperature, pressure, and other pertinent parameters for providing chemical action to access additional target substance 158 and/or to enhance permeability of the formation 178 such that additional portions of the target substance 180 may be retrieved economically. Accordingly, the production phase may be extended, resulting in increased total output from the wellbore 140.

In both examples of the present invention described above, the chemical agent is prevented from exposure and/or interaction with the formation beyond the portion specifically designated for applying the chemical agent. Instead of focusing on avoiding fracturing the wellbore to achieve stability, the present invention exploits and enhances fracturing of the wellbore in isolated portions (i.e., where the target fluid is to be released) of one or more formations along the wellbore using a chemical agent to cause a chemical action to access a target fluids within low permeability formations. Accordingly, the present invention accesses target fluids in formations that previously seemed unfeasible, impracticable, and/or uneconomical for oilfield production.

Osmotic action in a formation may be controlled in accordance with aspects of the invention. Initially, physicochemical property information of a portion of the formation is acquired. The physicochemical property information may be obtained by using, for example, log data analysis, direct measurement of the target formation or by analyzing cuttings (i.e., cutting analysis). A physicochemical property is any physical or chemical property of a substance. A physicochemical property may be, for example, in situ stress, chemical formula, temperature, etc.

Next, a type and a concentration for a chemical agent may be determined. As used herein, a chemical agent is a fluid that has a low chemical potential as compared to a pore fluid. For example, the type of the chemical agent may be determined to be a formate, such as cesium formate ($HCOO^-Cs^+$), potassium formate ($HCOO^-K^+$), sodium formate ($HCOO^-Na^+$), or the like, for producing the large pore pressure change demonstrated in the experiment of FIG. 7. Depending on the physicochemical property of the target formation, other formate may also be used such as ethyl formate ($CH_3CH_2(HCOO)$), methyl formate ($CH_3(HCOO)$), methyl chloro formate ($CH_3(OCOCl)$), triethyl orthoformate ($C_7H_{16}O_3$), trimethyl orthoformate ($C_4H_{10}O_3$), or the like. In another example, depending on the physicochemical property of the target formation, the type of the chemical agent may be determined to be a super electrolyte saturated solution, such as a sodium chloride solution, a potassium chloride solution, a calcium chloride solution, or other salt solutions. A super electrolyte saturated solution is a solution that contains more of the dissolved material than could be dissolved by the solvent under normal circumstances. In other examples, the chemical agent may be a Newtonian fluid rather than a viscous fluid used in prior art drilling, completion, or stimulation applications.

Next, the chemical agent may be applied at a portion of the formation, such as a shale formation or clayey sandstone formation. For example, a portion of the formation (see formation 174 of FIG. 8) may be a portion known or believed to hold a target fluid, such as hydrocarbons. The application of the chemical agent may reduce the pore pressure in the shale, based on the type and concentration of the chemical agent. Accordingly, the threshold to form a fracture as the pore pressure declines. For example, the portion of the formation exposed to the chemical agent may develop or produce fractures or micro-fractures under the in situ stress. In another example, when applying the chemical agent to the portion of the formation, the chemical agent may be applied at a lower pressure than an inert agent and achieve as good results in fracturing the target formation as would be achieved using the inert agent.

Another factor considered when addressing fracturing is hydraulic pressure, which is the pressure associated with a chemical agent at the interaction with the target formation (when fully applied). A threshold is the hydraulic pressure at which a portion of a formation begins to produce fractures, for example, by disintegration of the portion of the formation.

Figure 9:
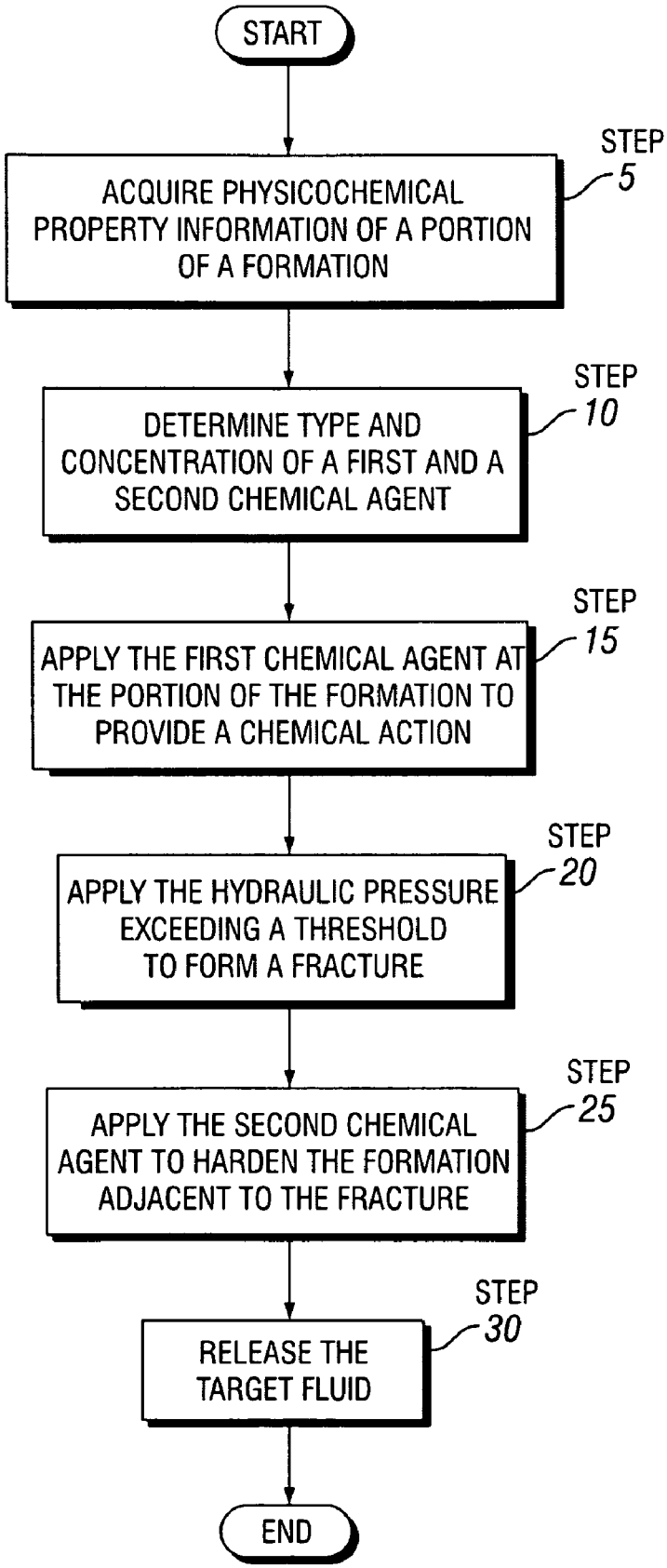
FIG. 9 show a flowchart of a method for accessing a target fluid in a formation in an oilfield operation in accordance with aspects of the invention.

FIG. 9 shows a flowchart of a method for accessing a target fluid in a formation in an oilfield operation in accordance with aspects of the invention. The process of FIG. 9 may be applied to target formations including shale, clayey sandstone, and/or other suitable low permeability formations to weaken the target formation and, optionally, harden the formation. Moreover, the chemical agents and pressures described in relation to FIG. 9 may be applied to an apparatus and formation shown in FIGS. 8 and/or 10.

FIG. 9 shows that initially, physicochemical property information of a portion of the formation is acquired in Step 5. The physicochemical property information may be acquired using a cutting analysis to obtain a chemical formula for one or more substances in a target formation. Other ways of acquiring physicochemical properties may include log data analysis, direct measurement, and using equipment such as the down-hole sensor 100 of FIG. 5. The chemical formula of the rock or the pore fluid (for example, as found in the fracture zone 154 of FIG. 8) may be used to determine a type and concentration of a chemical agent based on the physicochemical property information in Step 10. The chemical formulas and physicochemical property information may permit the pertinent parameters of the pore fluid, such as pore pressure, intermolecular potential, mole fractions, cation exchange capacity (CEC), and the like, to be evaluated using methods known in the art such as Gouy electric double layers, van der Waals forces, and other relevant methods or models. Optionally, one or more analysis methods disclosed in the various SPE published papers described above may also be applied.

Next, the first chemical agent may be applied at the portion of the formation to provide a chemical action in Step 15. The chemical action, where the chemical agent has a low chemical potential, may be used to dehydrate the portion of the formation. During Step 10, a first chemical agent may be selected from cesium formate, sodium formate, or other suitable materials having a lower chemical potential than the chemical potential of the pore fluid in the target formation. The target formation may respond to a high pore pressure change based on the exposure to the chemical agent by developing at least one fracture through osmotic action. The fracture may develop under the in situ stress. The fracture(s) may extend over a period of time and develop into a fracture zone.

Next, in some examples, a hydraulic pressure exceeding a threshold may be applied to form a fracture in the portion of the formation in Step 20. This step may be performed if the in situ stress alone is not sufficient to produce fractures or microfractures after the application of the chemical agent.

In another example, Step 20 may also be performed at the same time when the first chemical agent is applied. In yet another example, Step 20 may be performed prior to the first chemical being applied. One skilled in the art will appreciate that a high viscous fracturing fluid may be used for Step 20. The threshold used in this case may be significantly reduced compared to the threshold for fracturing the formation without the application of the chemical agent.

Next, a second chemical agent may be optionally applied to harden the formation adjacent to the fracture in Step 25. In some examples, the second chemical agent may be of the same type as the first chemical agent. In other examples, the chemical agents may be different. For example, a high ionic concentration fluid may be used. The second chemical agent has a high ionic concentration in relation to the pore fluid. In many formations, a 20 percent salt solution is higher than the pore fluid. One skilled in the art will appreciate that other fluids may be used as the second chemical agent, for example, other Newtonian fluids (i.e., a fluid that flows like water and has a shear stress that is linearly proportional to a velocity gradient in a direction perpendicular to a plane of shear).

Optionally, when applying the second chemical agent, for example, proppants (such as proppants 156 described in reference to FIG. 7) may be included in the second chemical agent. As discussed above, the proppants may contain time-released capsules, including time-released capsules containing formate and/or an ionic compound.

The hardened formation adjacent to the fracture enhances the utility of the proppants for preventing the fracture from closing under the in situ stress. Therefore, the target fluid may be released from the target formation in Step 30.

In some examples, the operations control center (see, operations control center 112 of FIG. 6) may couple with down-hole sensor (see, down-hole sensor 100 of FIG. 5) to control a compressor station (see, compressor station 74 of FIG. 4) to carry out the steps of FIG. 9 in an automated fashion.

Figure 10:
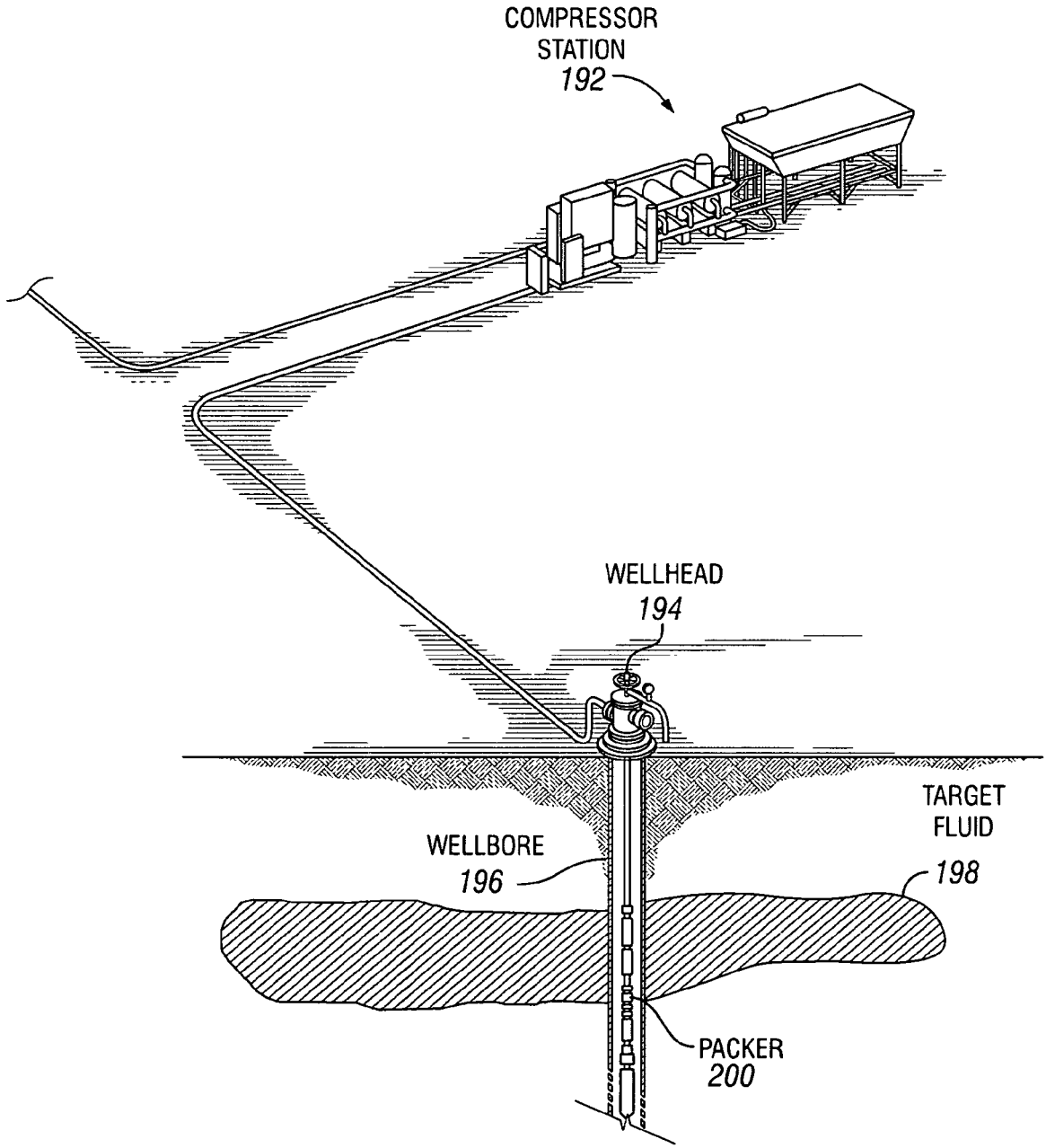
FIG. 10 shows a schematic of an cased hole operation for accessing the target fluid in a formation in accordance with aspects of the invention.

FIG. 10 shows a schematic of an cased hole operation for accessing the target fluid in a formation in accordance with aspects of the invention. A wellhead tubing and casing 194 permits equipment and fluids to move in and through cased wellbore 196. A compressor station 192 may provide at least one chemical agent at an appropriate pressure to the wellhead tubing and casing 194. The wellbore 196 may pass through various formations and target fluid(s). One or more packers may be used to isolate a target formation containing a target fluid 198. The target fluid 198 may be found in a low permeability substance, such as a shale or clayey sand formation. A packer 200 may isolate a segment of the wellbore coextensive with at least a portion of the target formation. A chemical agent may be applied through the packer 200 such that the pressure between gaskets on the packer is sufficient to inject the chemical agent into the portion of the formation containing the target fluid 198. One skilled in the art will appreciate that a single packer may operate with multiple gaskets to seal the wellbore 196. Further, multiple target fluids may be isolated along the cased wellbore 196 using a variety of methods known to those skilled in the art. Using the chemical agent(s) in the manner shown in FIG. 9 and described above, the target fluid can be released from the low permeability substance.

Although many examples above have been given relating to an oilfield operation, the invention may also be practiced in wells configured to extract other subsurface mineral substances, such as water, liquefied gases, gas, and the like.

While the invention has been described with respect to a limited number of aspects, those skilled in the art, having benefit of this disclosure, will appreciate that other aspects can be devised which do not depart from the scope of the invention as disclosed herein. Accordingly, the scope of the invention should be limited only by the attached claims.

What is claimed is:

1. A method for accessing a target fluid in a formation of an oilfield having at least one wellbore, the method comprising:

acquiring physicochemical property information of a portion of the formation, wherein the physicochemical property information comprises a chemical potential of a pore fluid in the formation;

determining a type and a concentration of a chemical agent based on the physicochemical property information of the portion of the formation, wherein the chemical agent comprises a formate with a chemical potential that is a lower chemical potential than a chemical potential of the pore fluid;

applying the chemical agent at the portion of the formation to provide a chemical action, wherein the chemical action comprises osmotic action, wherein the osmotic action extracts the pore fluid from the portion of the formation, wherein a pore pressure in the portion of the formation is reduced based on extracting the pore fluid to form a reduced pore pressure; and applying a hydraulic pressure exceeding a threshold to form a fracture in the portion of formation, wherein the threshold is reduced based on the reduced pore pressure, wherein the fracture releases the target fluid at the portion of the formation, and wherein the target fluid is released at the portion of the formation responding to the chemical action.

2. The method of claim 1, wherein the formation comprises at least one selected from a group consisting of shale and clayey sandstone.

3. The method of claim 1, wherein the chemical agent is a Newtonian fluid.

4. The method of claim 1, wherein the physicochemical property information further comprises in situ stress and temperature.

5. The method of claim 1, wherein the determining step further comprises:

determining a temperature, a pressure, and a volume of the chemical agent.

6. The method of claim 1, further comprising:

applying a hydraulic pressure to form a fracture in the portion of the formation, wherein the formation is hardened adjacent to the fracture to form a hardened formation based on extracting the pore fluid, and wherein the hardened formation allows the fracture to stay open and release the target fluid at the portion of the formation.

7. The method of claim 6, further comprising:

applying a proppant into the fracture, wherein the proppant supports the fracture and prevents the fracture from closing.

8. The method of claim 6, wherein the chemical agent comprises time released capsules comprising at least one selected from a group consisting of iconic compound and formate.

9. The method of claim 1, wherein applying the chemical agent comprises injecting the chemical agent through a portion of the wellbore.

10. A system for accessing a target fluid in a formation of an oilfield having a wellbore intersecting a portion of the formation, comprising:

a chemical agent for providing a chemical action at the portion of the formation, wherein the chemical agent comprises time released capsules comprising a formate;

equipment for acquiring physicochemical property information of the portion of the formation;

means for determining a type and concentration of the chemical agent based on the physicochemical property; and means for applying the chemical agent at the portion of the formation to release the target fluid in the portion of the formation responding to the chemical action, means for applying a hydraulic pressure to form a fracture in the portion of the formation, wherein the formation is hardened adjacent to the fracture to form a hardened formation based on the chemical action, and wherein the hardened formation allows the fracture to stay open and release the target fluid at the portion of the formation.

11. The system of claim 10, wherein the formation comprises at least one selected from a group consisting of shale and clayey sandstone.

12. The system of claim 10, wherein the physicochemical property information comprises a chemical potential of a pore fluid in the formation, wherein the type of the chemical agent comprises a chemical potential that is a lower chemical potential than a chemical potential of the pore fluid, wherein the chemical action comprises osmotic action, and wherein the osmotic action extracts the pore fluid from the portion of the formation.

13. The system of claim 10, wherein the chemical agent is a Newtonian fluid.

14. The system of claim 10, wherein the physicochemical property information further comprises in situ stress and temperature.

15. The system of claim 10, further comprising:

means for determining a temperature, a pressure, and a volume of the chemical agent.

16. The system of claim 10, further comprising:

means for applying a hydraulic pressure exceeding a threshold to form a fracture in the portion of the formation, wherein the threshold is reduced responding to the chemical action; and means for obtaining the target fluid from the fracture.

17. The system of claim 10, further comprising:

means for applying a proppant into the fracture, wherein the proppant supports the fracture and prevents the fracture from closing.

* * * * *